US009441436B2

(12) United States Patent
Hallundbæk

(10) Patent No.: US 9,441,436 B2
(45) Date of Patent: Sep. 13, 2016

(54) DOWNHOLE TUBING CUTTER TOOL

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 345 days.

(21) Appl. No.: 14/123,178

(22) PCT Filed: May 31, 2012

(86) PCT No.: PCT/EP2012/060255
§ 371 (c)(1),
(2), (4) Date: Nov. 29, 2013

(87) PCT Pub. No.: WO2012/164023
PCT Pub. Date: Dec. 6, 2012

(65) Prior Publication Data

US 2014/0124191 A1 May 8, 2014

(30) Foreign Application Priority Data

May 31, 2011 (EP) ..... 11168242

(51) Int. Cl.
*E21B 29/00* (2006.01)

(52) U.S. Cl.
CPC ..... *E21B 29/00* (2013.01); *E21B 29/005* (2013.01)

(58) Field of Classification Search
CPC ..... E21B 29/002; E21B 29/005; E21B 29/00
USPC ..... 166/55.6, 55.7, 55.8, 117.7, 170; 30/103, 108
See application file for complete search history.

(56) References Cited

U.S. PATENT DOCUMENTS 2,899,000 A * 8/1959 Medders ..... E21B 29/002 166/55.8
3,376,927 A * 4/1968 Brown ..... E21B 29/12 166/361
5,350,015 A * 9/1994 Hailey ..... E21B 29/005 166/55.8
6,024,166 A * 2/2000 McGarian ..... E21B 11/06 166/55.2

(Continued)

FOREIGN PATENT DOCUMENTS

CN 2244091 Y 1/1997
CN 2322733 Y 6/1999

(Continued)

OTHER PUBLICATIONS

International Search Report for PCT/EP2012/060255, mailed Aug. 2, 2012.

(Continued)

*Primary Examiner* — Kenneth L Thompson
(74) *Attorney, Agent, or Firm* — Nixon & Vanderhye P.C.

(57) ABSTRACT

The present invention relates to a downhole tubing cutter tool for submerging into a casing in a wellbore and separating an upper part of the casing from a lower part of the casing by cutting the casing from within, the tool extending in a longitudinal direction, comprising a tool housing having a first and a second housing part, a cutting arm which is pivotably connected with the first housing part and has a cutting edge in a first end, said arm being movable between a retracted position and a projected position in relation to the tool housing, an arm activation assembly for moving the cutting arm between the retracted position and the projected position, and a rotatable shaft arranged in the second housing part and connected with the first housing part for rotating the cutting arm.

20 Claims, 6 Drawing Sheets

(56) References Cited

U.S. PATENT DOCUMENTS

| | | | | |
|---|---|---|---|---|
| 6,712,158 | B2 * | 3/2004 | Moore | E21B 4/18 175/20 |
| 7,004,257 | B2 * | 2/2006 | Simpson | E21B 23/00 166/207 |
| 7,434,633 | B2 | 10/2008 | Lynde et al. | |
| 7,575,056 | B2 * | 8/2009 | Fuhst | B23D 45/128 166/298 |
| 2008/0066913 | A1 | 3/2008 | Lynde et al. | |
| 2010/0258293 | A1 | 10/2010 | Lynde et al. | |

FOREIGN PATENT DOCUMENTS

| | | | |
|---|---|---|---|
| CN | 2502004 | Y | 7/2002 |
| CN | 2564736 | Y | 8/2003 |
| CN | 2703117 | Y | 6/2005 |
| RU | 2012771 | C1 | 5/1994 |
| RU | 2196218 | C2 | 1/2003 |
| RU | 2256771 | C1 | 7/2005 |
| SU | 1654530 | A1 | 6/1991 |
| UA | 90722 | C2 | 5/2010 |

OTHER PUBLICATIONS

Written Opinion for PCT/EP2012/060255, mailed Aug. 2, 2012.
International Preliminary Report on Patentability issued in International Patent Application No. PCT/EP2012/060255 on Dec. 2, 2013.
Decision to Grant dated Apr. 1, 2016 issued in Russian Application No. 2013156840/03 with English translation (17 pages).
Office Action dated Oct. 10, 2015 issued in Chinese Application No. 201280026041.7 (5 pages).

* cited by examiner

DOWNHOLE TUBING CUTTER TOOL

FIELD OF THE INVENTION

The present invention relates to a downhole tubing cutter tool for submerging into a casing in a wellbore and separating an upper part of the casing from a lower part of the casing by cutting the casing from within, the tool extending in a longitudinal direction, comprising a tool housing having a first and a second housing part, a cutting arm which is pivotably connected with the first housing part and has a cutting edge in a first end, said arm being movable between a retracted position and a projected position in relation to the tool housing, an arm activation assembly for moving the cutting arm between the retracted position and the projected position, and a rotatable shaft arranged in the second housing part and connected with the first housing part for rotating the cutting arm. The invention also relates to downhole system comprising a downhole tubing cutter tool according to the invention, and a driving unit for moving the downhole tubing cutter tool forward in the casing.

BACKGROUND ART

After drilling, a borehole, a casing or a liner is run into the well by submerging the assembled string of a casing. Occasionally while doing so, the casing gets stuck due to a local collapse of the borehole around the casing, and the casing can consequently not be submerged any further. In order to locate the area of the collapse, a logging tool is submerged into the casing. When the area of the collapse is found, a perforation gun is run in to perforate in that area to loosen the casing. If this is not possible, the casing is cut just above the collapsed area.

The casing may be cut by explosives, which is dangerous, and there is therefore a need for a mechanical solution for separating the upper casing from the lower casing without getting stuck.

SUMMARY OF THE INVENTION

It is an object of the present invention to wholly or partly overcome the above disadvantages and drawbacks of the prior art. More specifically, it is an object to provide an improved downhole tool wherein downhole tool is able to cut off an upper part of the casing without using explosives.

The above objects, together with numerous other objects, advantages, and features, which will become evident from the below description, are accomplished by a solution in accordance with the present invention by a downhole tubing cutter tool for submerging into a casing or a drill pipe in a wellbore and separating an upper part of the casing from a lower part of the casing by cutting the casing from within, the tool extending in a longitudinal direction, comprising:

- a tool housing having a first and a second housing part,
- a cutting arm which is pivotably connected with the first housing part and has a cutting edge in a first end, said arm being movable between a retracted position and a projected position in relation to the tool housing,
- an arm activation assembly for moving the cutting arm between the retracted position and the projected position, and
- a rotatable shaft arranged in the second housing part and connected with the first housing part for rotating the cutting arm, wherein the arm activation assembly comprises:

- a piston housing arranged in the first housing part and comprising a piston chamber, and
- a piston member arranged inside the piston chamber and engaged with the cutting arm to move the cutting arm between the retracted position and the projected position, the piston member being movable in the longitudinal direction of the downhole tool and having a first piston face and a second piston face, the piston member being capable of applying a projecting force on the cutting arm by applying hydraulic pressure on the first piston face and moving the piston in a first direction.

Hereby, it may be obtained that the casing can be separated in an upper part of the casing from a lower part of the casing by cutting the casing from within without the use of explosives.

In an embodiment, the first and the second housing parts may be rotatably connected and the rotatable shaft may be rotatably arranged in the second housing part and connected with the first housing part for rotating the first housing and the cutting arm in relation to the second housing part.

By the arm being movable between a retracted position and a projected position is meant a retracted position and a projected position in relation to an axial extension of the tool housing.

In another embodiment, the downhole tubing cutter tool may be submersible into a casing in a well by a wireline or by means of tubing, such as coiled tubing or a drill pipe.

Furthermore, the downhole tubing cutter tool may be a wireline tool being submerged into the well via a wireline.

In one embodiment, the piston chamber may be divided into a first chamber section and a second chamber section, and the hydraulic pressure on the first piston face, moving the piston in the first direction, may be applied into the first chamber section.

In another embodiment, hydraulic pressure may be applied into the second chamber section moving the piston member in a second direction opposite of the first direction.

In yet another embodiment, the chamber may be divided by the piston.

Further, the chamber may be divided by a partitioning wall of the piston housing and through which the piston member extends.

Moreover, the second chamber may have a channel allowing well fluid to enter the second chamber when the piston member is moved in the first direction.

Additionally, a valve may be arranged in the channel.

Furthermore, a spring member may be arranged in the first housing part applying a spring force to move the piston member in a second direction opposite the first direction.

Moreover, the spring member may be arranged in the second chamber section.

Additionally, the spring member may be a helical spring surrounding parts of the piston member.

In one embodiment, the piston member may have a groove cooperating with a second end of the cutting arm.

Also, the groove may be a circumferential groove.

In one embodiment, the piston member may be arranged coaxially in the tool housing.

In another embodiment, the cutting arm may project radially from the tool housing.

In yet another embodiment, the downhole tubing cutter tool may comprise a plurality of cutting arms, preferably three cutting arms.

Further, a downhole tubing cutter tool according to the invention may comprise an anchor section for anchoring the second housing part in the casing.

Moreover, the anchoring section may be hydraulically activated.

In one embodiment, the cutting arm in cross-section may have an edge forming an outermost point of the arm when the arm is in its projected position, and the cutting edge may be arranged at the edge of the cutting arm forming the edge of the cutting arm.

In another embodiment, the tool may comprise a swivel connection arranged between the first and the second housing parts.

Also, a downhole tubing cutter tool according to the invention may comprise a gear section.

Furthermore, a downhole tubing cutter tool according to the invention may comprise a rotation unit, such as an electrical motor or a hydraulically driven impellor.

The downhole tubing cutter tool may further comprise a gear section.

In an embodiment, the gear section may be arranged between the rotation unit and the cutting arm.

Furthermore, the gear section may be arranged between the rotation unit and the rotatable shaft.

Moreover, the gear section may be arranged between the rotatable shaft and the cutting arm.

In one embodiment, the cutting arm may be L-shaped creating a heel part and pivotably connected around a pivot point arranged in the heel part.

Furthermore, the cutting arm may have a centre axis and rotate around the centre axis.

Additionally, the cutting arm may rotate around a longitudinal tool axis as well as the centre axis.

Also, the cutting arm may comprises an outer sleeve through which an arm shaft extends, the arm shaft being coupled to the rotatable shaft and attached to a rotatable cutting head for transmitting rotational force to the cutting head.

By providing a rotatable cutting head on the cutting arm being moved along the inner face of the casing or drill pipe, the cutting head performs an operation that may be referred to as climb milling. This improves the ability of the downhole tubing cutter tool to cut though the casing or drill pipe. Further, it reduces the risk of the downhole tubing cutter tool stalling if the cutting arm gets stuck or jammed when cutting through the casing or drill pipe. This is due to the fact that the cutting motion is not only provided through rotation of the cutting arm around the centre axis of the downhole tubing cutter tool, but also through rotation of the cutting head of the cutting arm itself. The cutting head is thus able to rotate at another speed than the cutting arm, which reduces the risk of the cutting head reducing the rotational speed of the cutting arm around the centre axis of the tool.

In an embodiment, the cutting edge may be provided on the cutting head.

The downhole tubing cutter tool may further comprise a gearing assembly provided in the first housing part, the rotatable shaft being coupled to a first gear of the gearing assembly and the arm shaft being coupled to a second gear of the gearing assembly, whereby rotational force is transmitted from the rotatable shaft to the cutting head via the arm shaft.

In an embodiment, the gear ration of the gearing assembly may be 1:1.

Furthermore, the gearing assembly may be a planetary gear, the rotatable shaft being coupled to a sun gear of the gearing assembly and the arm shaft being coupled to a planet gear of the gearing assembly, whereby rotational force is transmitted from the rotatable shaft to the cutting head via the arm shaft.

Moreover, the arm shaft may comprise a first shaft part and a second shaft part interconnected by a double Cardan joint for transmitting rotational force from of the first shaft part to the second shaft part.

Additionally, the first shaft part and the second shaft part may connected by a universal joint.

The downhole tubing cutter tool may further comprise a rotatable sleeve provided around the rotatable shaft, wherein the first housing part is rotated by a rotatable sleeve.

Moreover, the motor may rotate the rotatable shaft and the rotatable sleeve. In another embodiment, the cutting edge may comprise a plurality of cutting inserts.

In yet another embodiment, the cutting edge is made from a tungsten carbide.

Additionally, the cutting inserts may be arranged in at least to layers.

Further, a downhole tubing cutter tool according to the invention may comprise a pump for supplying the hydraulic pressure, the pump being rotatable arranged inside the tool housing, whereby the hydraulic pump rotates along with the first housing part and the cutting arm.

In an embodiment, the downhole tubing cutter tool may further comprise a pump for supplying the hydraulic pressure for moving the cutting arm between the retracted position and the projected position, the pump being arranged inside the tool housing.

Furthermore, the downhole tubing cutter tool may comprise a pump for supplying the hydraulic pressure for moving the cutting arm between the retracted position and the projected position, the pump being arranged inside the second tool housing.

Moreover, the downhole tubing cutter tool may comprise a pump arranged in the tool for supplying the hydraulic pressure for moving the cutting arm between the retracted position and the projected position, and comprising a motor arranged in the tool for driving a pump and rotating the rotatable shaft, the motor being supplied with power via a wireline.

Furthermore, the downhole tubing cutter tool may further comprise an anchor section for anchoring the second housing part in the casing.

In addition, the anchor section may comprise two pivotably connected anchor arms, one anchor arm pivotably connected to the second housing part and the other anchor arm pivotably connected with a piston sleeve which is slidable within the second housing part.

Finally, the anchor arms may have a serrated end facing an inner face of the casing when being in a projected position.

Moreover, the pump may be driven by an electrical motor powered through a wireline.

Furthermore, the tool housing may comprise channels for fluidly connecting the pump and the piston chamber.

Finally, the invention relates to a downhole system, comprising:

- a downhole tubing cutter tool according to any the invention, and
- a driving unit for moving the downhole tubing cutter tool forward in the casing.

In an embodiment, the driving unit may be a self-propelling unit able to convey itself and the downhole tubing cutter tool forward in the well.

Furthermore, the driving unit may comprise wheels arranged on wheel arms projectable from the tool housing so that the wheels contact an inner surface of the well.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
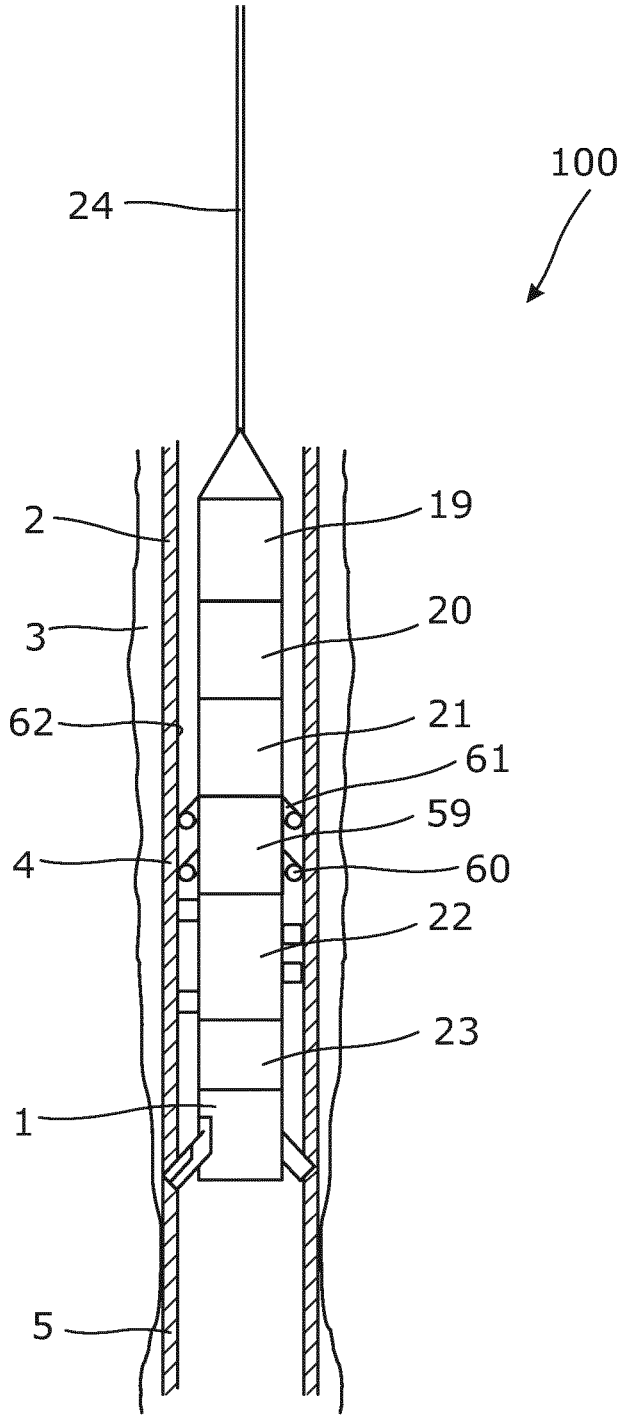
FIG. 1 shows a downhole system comprising a downhole tubing cutter tool.

FIG. 1 shows a downhole tubing cutter tool 1 for submerging into a casing 2 or drill pipe 2 in a wellbore 3 in the event that the casing or drill pipe is stuck. This is done to separate an upper part 4 from a lower part 5 of the casing or drill pipe by cutting the casing from within by means of a cutting edge 10 arranged on a projected cutting arm 9. In FIG. 1, the downhole tubing cutter tool 1 is comprised in a downhole system having an electronic section 19 for controlling the electricity supply before being directed to a rotation unit, such as an electrical motor 20, driving a hydraulic pump 21. The downhole system further comprises an anchor section 22 and a gear section 23. The downhole tubing cutter tool 1 is submerged into the casing, and the anchor section 22 of the downhole system is hydraulically activated to anchor a second part 8 of the tool housing of the system in relation to the casing 2. The motor is powered through a wireline 24 and the electronic section 19 and drives the pump and rotates a rotatable shaft 12 for rotating the cutting arm 9 for separating the upper part 4 from the lower part 5 of the casing 2. Thus, the downhole tubing cutter tool 1 is submerged into the well or casing only by a wireline, e.g. with another kind of power supply line, such as an optical fibre, and not by tubing, such as coiled tubing, drill pipe or similar piping.

Figure 2:
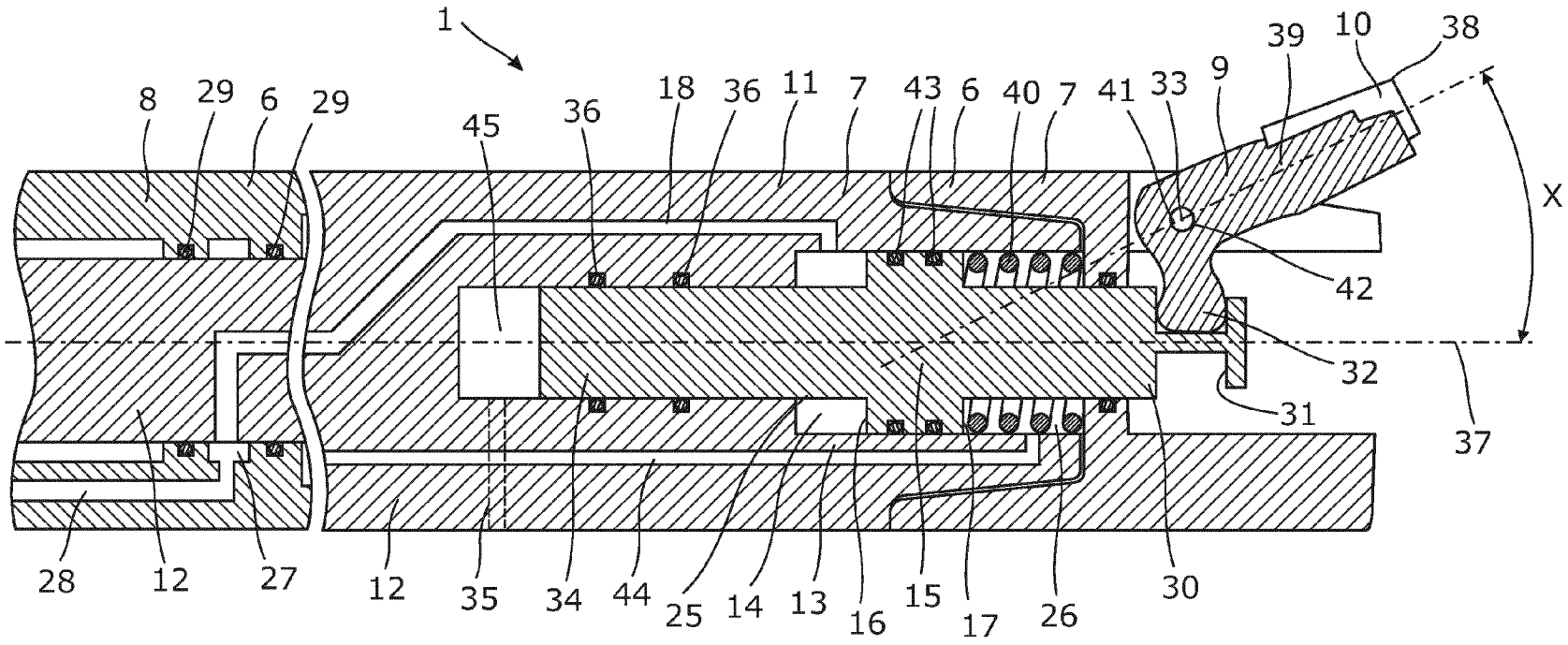
FIG. 2 shows a cross-sectional view of the downhole tubing cutter tool, wherein a cutting arm is in its projected position.

As shown in FIG. 2, the downhole tubing cutter tool 1 comprises a tool housing 6 having a first 7 and a second 8 housing part and a cutting arm 9 being pivotably connected with the first housing part and having a cutting edge 10 in a first end. The arm is movable between a retracted position and a projected position in relation to the tool housing. The arm is shown in its projected position in FIG. 2. The tool further comprises an arm activation assembly 11 for moving the cutting arm 9 between the retracted position and the projected position. A rotatable shaft 12 penetrates the second housing part 8 and is connected with, and forms part of, the first housing part for rotating the cutting arm.

The arm activation assembly 11 comprises a piston housing 13 arranged in the first housing part 7 and comprising a piston chamber 14. A piston member 15 is arranged inside the piston chamber and engages with the cutting arm 9, thereby moving the cutting arm 9 between the retracted position and the projected position. The piston member 15 is movable in a longitudinal direction of the downhole tubing cutter tool and has a first piston face 16 and a second piston face 17. Hydraulic fluid from the pump is pumped into a first chamber section 25 of the chamber 14 through a first fluid channel 18, applying a hydraulic pressure on the first piston face 16, and the piston moves in a first direction, applying a projecting force on the cutting arm 9.

When the cutting arm is projected to pressure against an inner face of the casing or drill pipe and is simultaneously rotated by the motor through the rotatable shaft, the cutting edge 10 is capable of cutting through the casing or drill pipe. Hereby, it is obtained that an upper part of the casing can be separated from a lower part of a casing by cutting the casing from within without the use of explosives.

In FIG. 2, the rotatable shaft 12 supplies the fluid to the first section 25 of the chamber 14. The fluid from the pump is supplied to the shaft 12 through a circumferential groove 27 fluidly connected with a second fluid channel 28 in the second housing part 8. Thus, the fluid from the second fluid channel 28 is distributed in the circumferential groove 27 so that the first fluid channel 18 in the rotatable shaft 12 is always supplied with pressurised fluid from the pump while rotating. The circumferential groove 27 is sealed off by means of circumferential seals 29, such as O-rings, on both sides of the circumferential groove 27.

The piston member moves 15 in the longitudinal direction of the tool 1 inside the piston chamber and divides the chamber 14 into a first chamber section 25 and a second chamber section 26. When the piston member moves in the first direction, a spring member 40 abutting the second piston face 17 opposite the first piston face 16 is compressed. As the spring member is compressed, so is the second chamber section, and the fluid therein flows out through a fourth channel 44 fluidly connected with the first channel 18. The spring member, which is a helical spring surrounding part of the piston member arranged in the second chamber section 26, is thus compressed between the second piston face 17 and the piston chamber 14. The piston member has a first end 30 extending out of the piston housing 13 and engaging the cutting arm by having a circumferential groove 31 into which a second end 32 of the cutting arm extends. The second end of the cutting arm is rounded to be able to rotate in the groove. The cutting arm is pivotably connected with the first housing around a pivot point 33. In the other and second end 34 of the piston member, the piston member extends into the shaft 12. When the piston member is moved in the first direction, a space 45 is created between the second end 34 of the piston member and the shaft. This space 45 is in fluid communication with the well fluid through a third channel 35, which is illustrated by a dotted line. In this way, the piston does not have to overcome the pressure surrounding the tool in the well. The second end 34 of the piston member is provided with two circumferential seals 36 in order to seal off the piston chamber from the dirty well fluid.

When the cutting operation is over and the casing or drill pipe has been separated in an upper and a lower part, the hydraulic pressure from the pump is no longer fed to the first channel, and the spring member forces the piston member 15 in a second direction opposite the first direction along the longitudinal direction 37 of the tool, as indicated in FIG. 2.

When seen in cross-section, the cutting arm has an edge 38 forming an outermost point of the arm when the arm is in its projected position, and the cutting edge 10 is arranged at that edge and forms the edge, so that the cutting edge is the first part of the cutting arm to abut the inner face of the casing or drill pipe. In this way, the casing or drill pipe can be separated from within the casing or drill pipe. When seen in the cross-sectional view of FIG. 2, the cutting arm thus moves from a retracted position in which the first part 39 of the arm is substantially parallel to the longitudinal direction of the tool to the projected position in which the first part 39 of the arm has an angle x to the longitudinal direction of the tool. Thus, the cutting arm projects radially from the round tool housing. As shown in the cross-sectional view of FIG. 2, the cutting arm is L-shaped, creating a heel part 50, and is pivotably connected around the pivot point 33 in the heel part. Thus, the cutting arm has a first end with the cutting edge and a second end cooperating with the piston member. Between the first and second ends, in a pivoting point, a pin 41 penetrates a bore 42 in the cutting arm.

In the drawings, the downhole cutting tool is shown with only one cutting arm for illustrative purpose. However, in another embodiment, the tool has three cutting arms arranged at 120° apart from each other.

The piston member is substantially coaxially arranged in the tool housing and has two circumferential seals 43, such as O-rings.

Figure 3:
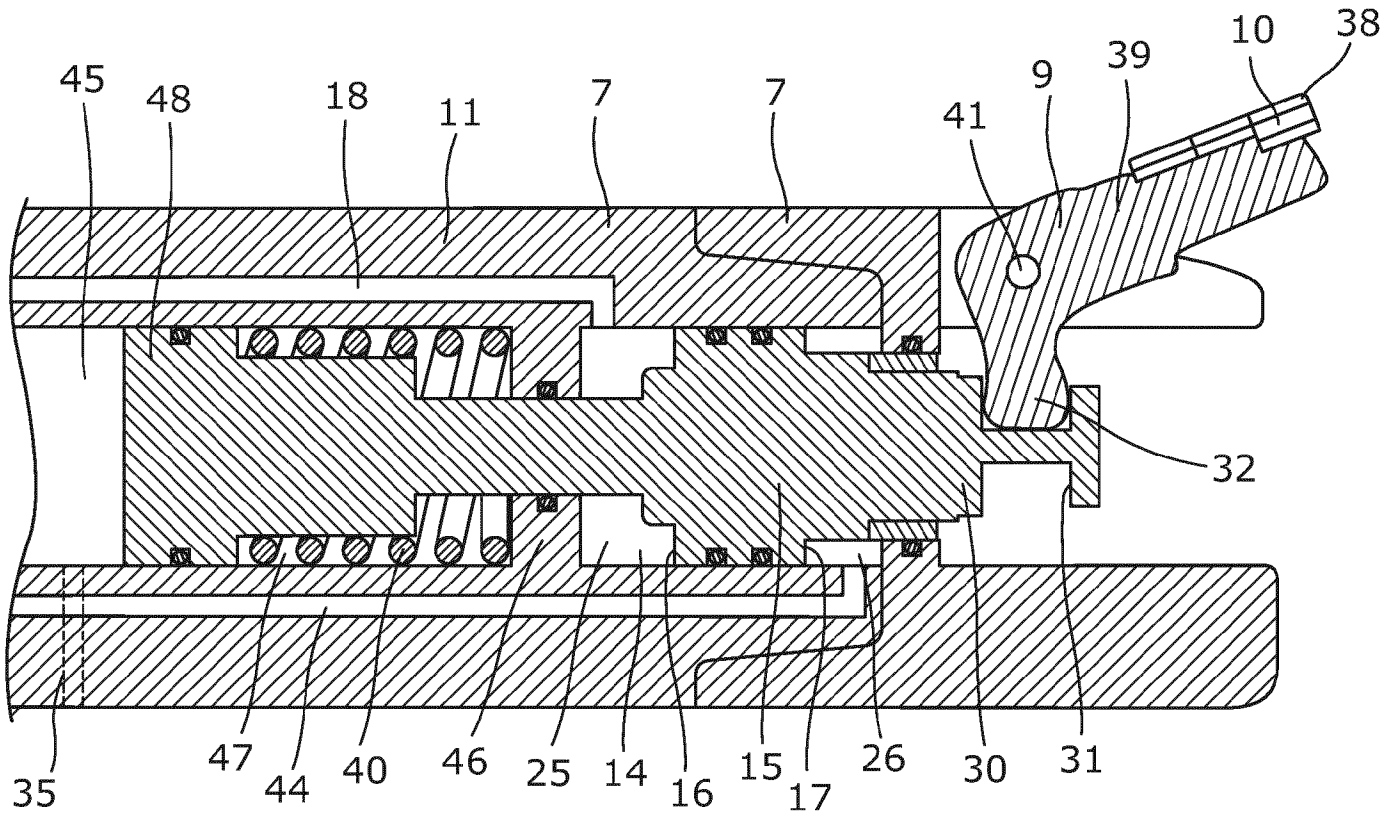
FIG. 3 shows a cross-sectional view of another embodiment of the downhole tubing cutter tool, wherein a cutting arm is in its projected position.

In FIG. 3, the piston member divides the piston chamber into the first and second chamber sections, but the chamber is also divided by a partitioning wall 46 of the piston housing through which the piston member extends. The chamber is divided into a third chamber section 47 in which the spring member is arranged. Thus, the spring member is compressed between the partitioning wall 46 and a second piston part 48 arranged in the end of the part of the piston extending through the partitioning wall 46.

In FIG. 3, hydraulic pressure is applied into the second chamber section through the fourth channel 44, moving the piston member in a second direction opposite the first direction. Thus, the spring member functions as a fail-safe precaution if the tool breaks down and no hydraulic pressure can be generated when the spring member forces the cutting inwards to its retracted position, and the tool can be pulled out of the well.

In FIG. 3, the cutting edge is provided with a plurality of cutting inserts so that when one is worn out, the next cutting insert will be ready for cutting further into the wall of the casing or drill pipe.

Figure 4:
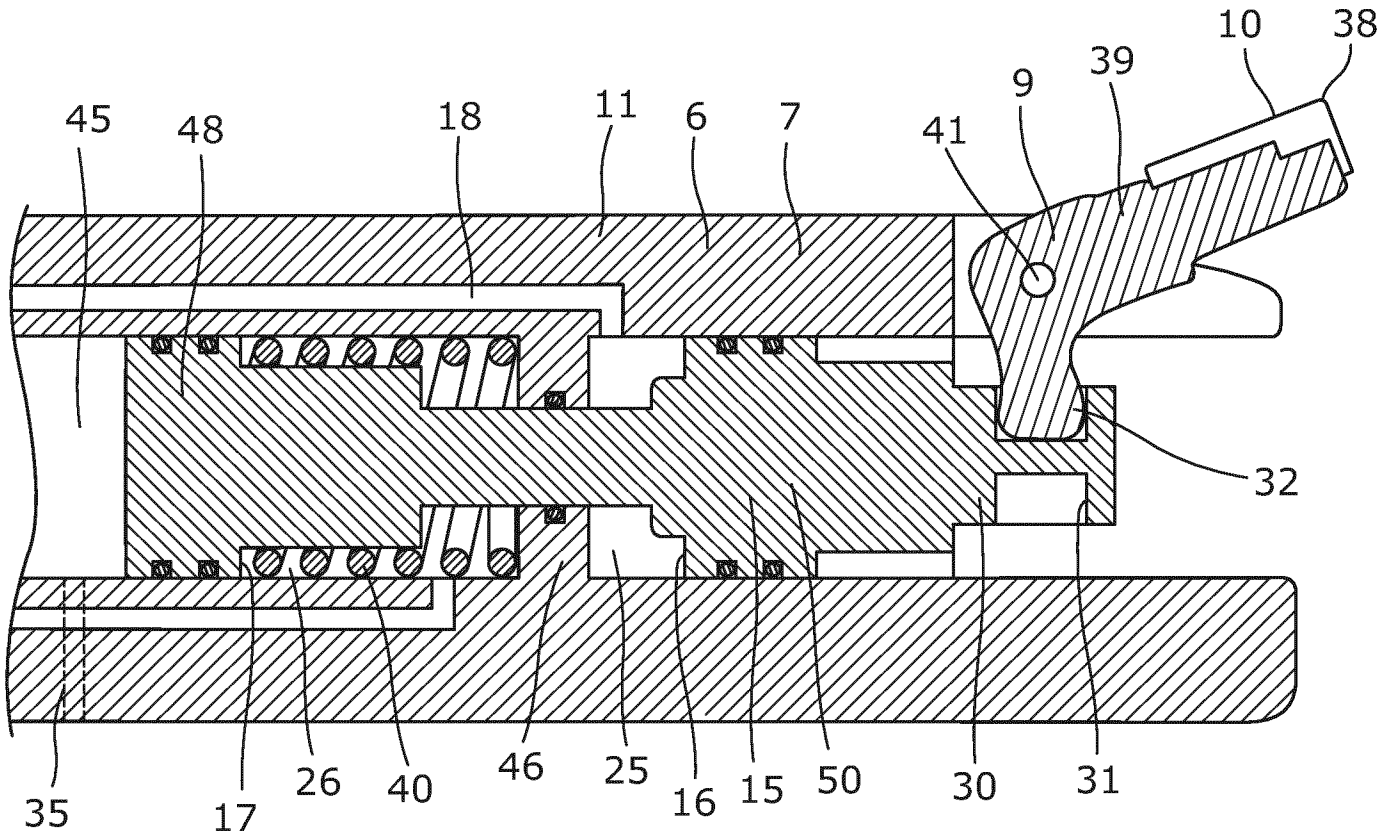
FIG. 4 shows a cross-sectional view of another embodiment of the downhole tubing cutter tool, wherein a cutting arm is in its projected position.

In FIG. 4, the piston chamber is divided by a partitioning wall 46 of the piston housing into the first 25 and second 26 chamber sections, and the piston member extends through the wall. The piston member has a first piston part 50 on one side of the partitioning wall 46 and a second piston part 48 on the other side of the partitioning wall 46. The first part of the piston member and the partitioning wall 46 together with the piston housing form the first chamber section 25, and the second part of the piston member and the partitioning wall 46 together with the piston housing form the second chamber section 26. The spring member 40 is arranged in the second chamber section and is thus compressed between the partitioning wall 46 and a second piston part 48.

Figure 5:
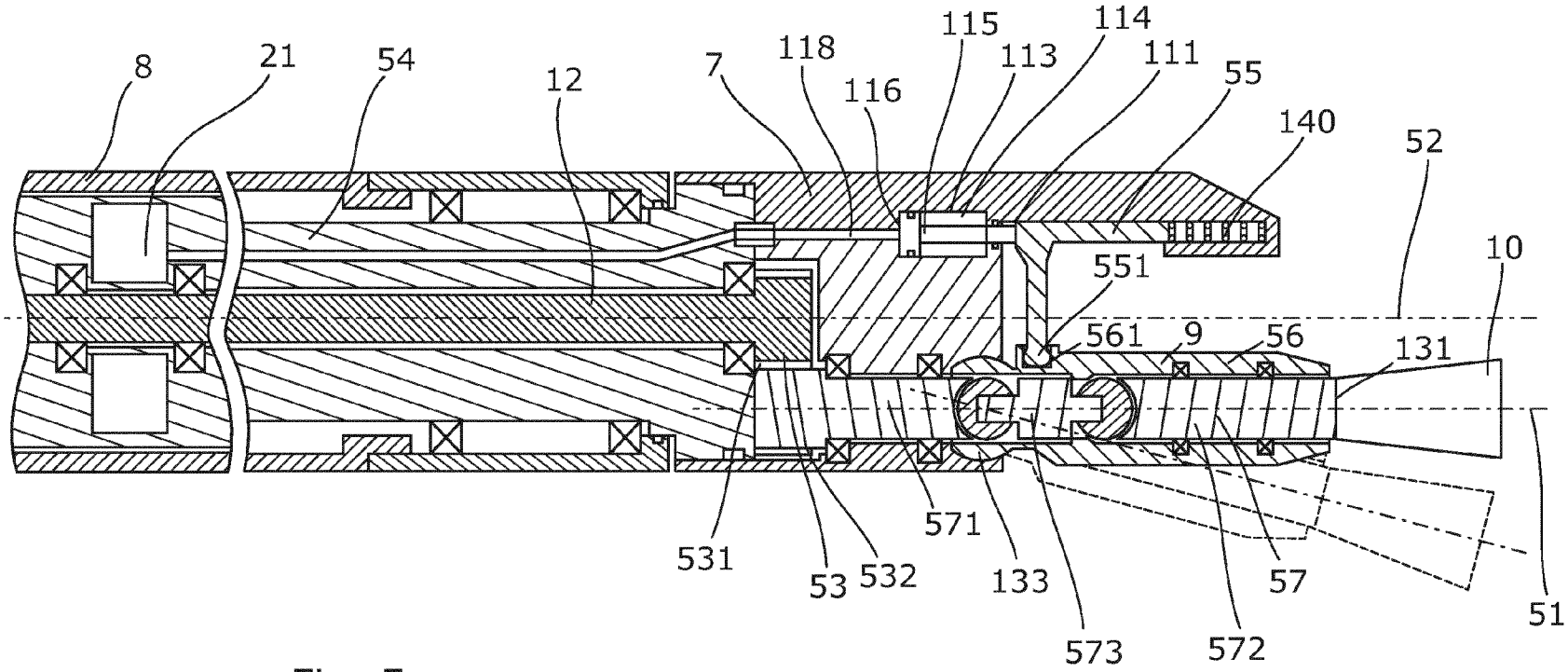
FIG. 5 shows a cross-sectional view of another embodiment of the downhole tubing cutter tool comprising a rotatable cutting head.

FIG. 5 shows another embodiment of a downhole tubing cutter tool 1. Like the embodiments described above, the downhole tubing cutter tool 1 comprises a tool housing 6 having a first 7 and a second 8 housing part and a cutting arm 9 being pivotably connected with the first housing part and having a cutting edge 10 in a first end. The arm 9 is movable between a retracted position and a projected position in relation to the tool housing. This embodiment differs from the previously described embodiments in that the cutting arm 9 comprises a rotatable cutting head 110 capable of rotating around a centre axis 51 of the cutting arm. The cutting arm 9 is thus rotated around a centre axis 52 of the downhole tubing cutter tool and extends in a longitudinal direction 37 of the downhole tubing cutter tool 1 while the cutting head 110 is rotated simultaneously. Thus, the cutting arm 9 is rotated at one rotational speed around the centre axis 52 of the downhole tubing cutter tool, and the cutting head is rotated at another rotational speed around the centre axis 51 of the cutting arm. The cutting head is thus rotated around its own centre axis 51 while being rotated around the tool centre axis 52.

For rotating the rotatable cutting head 110, the downhole tubing cutter tool 1 comprises a rotatable shaft 12 rotated by a motor 20. The rotatable shaft 12 extends through the second housing part 8 and the first housing part 7, and in the first housing part, the rotatable shaft provides a rotational input for a gearing assembly 53, through which rotation of the rotatable cutting head is provided. For moving the cutting arm 9 between the retracted position and the projected position, the downhole tubing cutter tool 1 comprises an arm activation assembly 111.

The gearing assembly comprises a first gear 531 rotated by the rotatable shaft 12 and a second gear 532 to which the rotatable cutting head 110 is coupled. When the first gear 531 is rotated by the rotatable shaft, the second gear 532 rotates around its own axis to rotate the rotatable cutting head 100. The rotation of the cutting arm 9 around the centre axis 52 of the downhole tubing cutter tool is provided through rotation of the first housing part 7. Thus, the second housing part 8 is kept stationary while the first housing part 7 rotates. The first housing part 7 is rotated by a rotatable sleeve 54 provided around the rotatable shaft 12. The rotatable sleeve 54 is also rotated by the motor 20. The mutual rotation of the rotatable shaft and the rotatable sleeve is adapted to provide the required rotation of the cutting arm 9 around its own axis 51 as well as around the centre axis 52 of the downhole tubing cutter tool.

In one embodiment, the number of teeth on the first and the second gear of the gearing assembly is the same, thereby providing a 1:1 gear ration. Alternatively, the number of teeth on the second gear may be greater than that of the first gear, thereby constituting a reduction gear.

In an alternative embodiment, the gearing assembly may be a planetary gear comprising a sun gear 531 rotated by the rotatable shaft 12 and a planet gear 532 to which the rotatable cutting head 110 is coupled. When the sun gear is rotated by the rotatable shaft, the planet gear rotates around its own axis to rotate the rotatable cutting head 100. The gearing between the rotational shaft and the cutting arm may be designed in a number of other ways without departing from the scope of the invention.

The cutting arm 9 comprises an outer sleeve 56 and an arm shaft 57 connected with the rotatable cutting head arranged inside the outer sleeve for transferring the rotational output of the second gear 532 to the rotatable cutting head. The rotatable cutting head is provided with a cutting edge 10. In a second end opposite the cutting edge, the cutting arm is pivotally connected with the first housing part 7 by a ball and socket joint 133. The arm shaft 57 is rotatable around the centre axis 51 and comprises a first shaft part 571 and a second shaft part 572. The first shaft part 571 is coupled to the second gear of the gearing assembly and thus rotates accordingly. Further, the first shaft part 571 is coupled to the second shaft part 572 via a double Cardan joint 573 to transmit rotational force from one shaft part to the other when the cutting arm is in the projected position. In another embodiment, the first shaft part may alternatively be coupled to the second shaft part via a single Cardan joint, also known as a universal joint, a universal coupling, a U-joint, etc. Thus, when the cutting arm is moved into the projected position, rotational force is transmitted from the second gear via the arms shaft to the rotatable cutting head.

The arm activation assembly 111 comprises a piston housing 113 arranged in the first housing part 7 and comprising a piston chamber 114. A piston member 115 is arranged inside the piston chamber and engages with an activation element 55 adapted to move the cutting arm 9 between the retracted position and the projected position. The piston member 115 is movable in a longitudinal direction of the downhole tubing cutter tool and has a first piston face 116. Hydraulic fluid from the hydraulic pump 21 is pumped through a first fluid channel 118 into the chamber 114, applying a hydraulic pressure on the first piston face 116. The piston moves in a first direction, and the piston member applies a projecting force on the cutting arm 9. When the piston member moves in the first direction, a spring member 140 abutting the activation element 55 is compressed. To retract the cutting arm from the projected position (indicated by the dotted lines), the supply of hydraulic fluid to the piston chamber 114 is terminated and the spring member 140 forces the piston member 115 in a second direction opposite the first direction along the longitudinal direction 37 of the tool.

The spring member 140 may also be arranged inside the piston housing 113, thereby providing a retraction force of the cutting arm. When the piston member moves in the first direction, a spring member 140 is compressed in the piston housing. To retract the cutting arm from the projected position, the supply of hydraulic fluid to the piston chamber 114 is terminated and the spring member 140 forces the piston member 115 in a second direction opposite the first direction along the longitudinal direction 37 of the tool.

Alternatively, the hydraulic pump 21 is provided in the second housing part 8 and attached to the rotatable sleeve 54, whereby the hydraulic pump rotates along with the rotatable sleeve and the first housing part 7 and the cutting arm rotate around the centre axis 52 of the downhole tubing cutter tool.

In FIG. 5, the activation member 115 has the shape of an L-profile of which a first end 551 engages with a recess 561 in the outer sleeve of the cutting arm 9. The first end 551 of the activation member is rounded in order for the recess 561 to be able to rotate around the first end 551 when the cutting arm is moved into the projected position. It is envisaged by the skilled person that the arm activation assembly may be constructed using various other principles without departing from the invention. The activation member may be adapted to move the cutting arm from the retracted position to the extended position only. The spring member 140 may thereby be adapted to provide a retraction force directly to the cutting arm to move the cutting arm from the projected position to the retracted position.

Thus, when the cutting arm is in the projected position and pressed against an inner face of the casing or drill pipe, the simultaneous rotation of the cutting arm around the axis 52 and the rotatable cutting head around the axis 51 enables cutting of the casing or drill pipe. In this way, a first part of the casing or drill pipe above the cutting head is separated from a second part of the casing or drill pipe below the cutting head.

In a further embodiment, the downhole tubing cutter tool 1 may comprise more that one cutting arm, such as three cutting arms, extendable from the tool housing along a periphery thereof. In this embodiment, each of the cutting arms is attached to a planet gear of the planetary gear, and the cutting arms are thus rotated by the sun gear. Thus, the downhole tubing cutter tool 1 comprises three activation members 115 enabling movement of each cutting arm between the retracted and projected positions.

Figure 6:
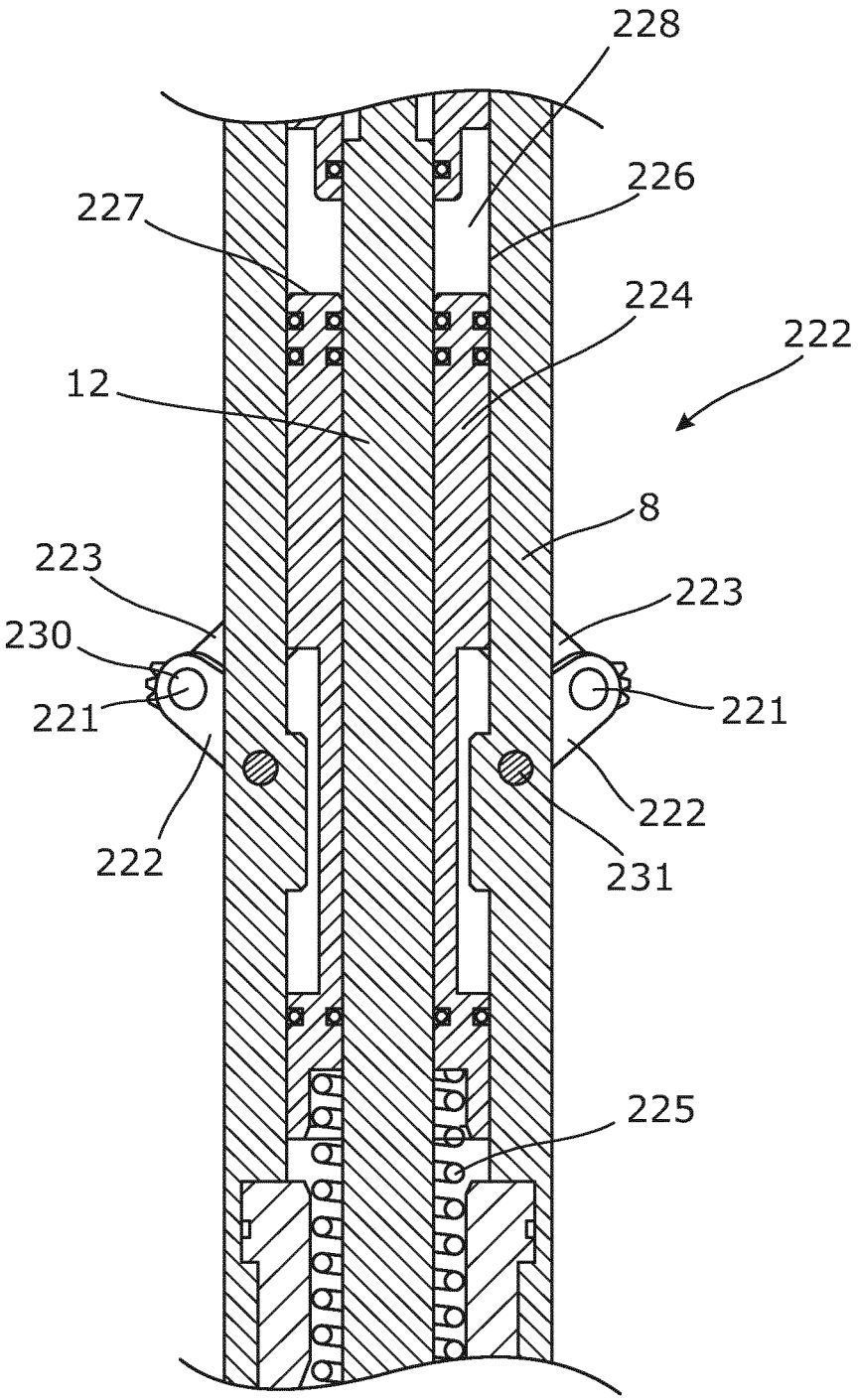
FIG. 6 shows a cross-sectional view of an anchor section of a downhole tubing cutter tool.

FIG. 6 shows a cross-sectional view of an alternative anchor section 22 than the anchor section shown in FIG. 1 for anchoring the second housing part 8 of the tool housing in relation to the casing 2. The anchor system 22 comprises a plurality of anchors 221 which may be extended from the second housing part 8, as shown in FIG. 6. Each of the anchors 221 comprises two anchor arms 222, 223 pivotally connected at a first pivot point 230; a first anchor arm 222 pivotally connected to the second housing part 8 at a second pivot point 231 and a second anchor arm 223 pivotally connected to a piston sleeve 224 provided in a bore 226 in the second housing part 8, around the rotatable shaft 12. The piston sleeve 224 is thus an annular piston. The piston sleeve 224 is under the influence of a spring member 225 providing a fail-safe system ensuring that the plurality of anchors 221 is retracted in order to be able to retrieve the tool in the event that power is lost or another breakdown occurs. In FIG. 6, the anchors 221 are extended, and the spring member 225 is compressed by the piston sleeve being force in a first direction away from the cutting arm by a hydraulic fluid supplied under pressure to piston chamber 228, thereby acting on a piston face 227 of the piston sleeve 224. When the supply of hydraulic fluid is terminated, the pressure on the piston face 227 reduces and the spring member displaces the piston sleeve in a second direction opposite the first direction, whereby the anchors 221 are retracted.

The hydraulic fluid for displacing the position sleeve 224 is supplied by a hydraulic system separate from the hydraulic system used for supplying the hydraulic pressure for moving the cutting arm between the retracted position and the projected position. By using two separate hydraulic systems, the cutting arm and the anchors may be operated independently of one another. For example, the cutting arm may be retracted if problems occur during the cutting operation, without affecting the position of the downhole tubing cutter tool in the well. Thus, the downhole tubing cutter tool remains stationary in the well, and the cutting arm may be projected once again to continue the interrupted cutting procedure.

Had the downhole tubing cutter tool not been kept stationary during retraction of the cutting arm, it would be difficult to determine the position of the initiated cutting, and the cutting procedure would have to start all over again at a new position. When having to start all over, the cutting edge or bits on the cutting arm may have been abraded too much for the cutting tool to be able to cut through the casing at the new position, and the tool may therefore have to be retracted from the well to replace the cutting edge, cutting insert or bits of the cutting arm in order to be able to cut all the through the casing.

To secure that the downhole tubing cutter tool does not remain anchored in the well due to a power loss or malfunction of one of the hydraulic systems, the hydraulic system of the anchor section comprises a timer for controlling the supply of hydraulic fluid hydraulic to the piston chamber 228. When the cutting arm is retracted, the timer registers the time elapsed. Depending on operation-specific parameters, the timer may be set to retract the anchors at any time after retraction of the cutting arm, preferable between 15 and 180 minutes, and more preferably between 30 and 60 minutes after retraction of the cutting arm. When the set time has elapsed, the timer activates a valve which controls the pressure in the piston chamber 228. As the valve is activated, the pressure in the piston chamber drops and the piston member 225 displaces the piston sleeve to retract the anchors. The valve control comprises a battery, and activation of the valve may be powered by the battery if the power to the cutting tool is cut.

The anchor arm 222 has an end surface facing the inner face of the casing when being in the projected position, which is serrated to improve the ability of the anchor arm 222 to engage with the inner face of the casing.

The tubing cutter tool comprises a second pump for driving the separate hydraulic system for activating the anchor system. Thus, the shaft around which the piston sleeve extends may have a fluid channel for supplying fluid to the projection of the cutting arm.

The cutting edge or cutting insert is made from any suitable material, such as tungsten carbide.

The downhole system may further comprise a driving unit, such as a downhole tractor for moving the downhole tubing cutter tool forward in the casing, as shown in FIG. 1. The driving unit comprises wheels 60 arranged on wheel arms 61 projectable from the tool housing in order for the wheels 60 to contact an inner surface 62 of the casing 2.

The spring member 40 may be any type member exerting a spring force on the second piston face 17 such as a coil spring, helical spring, bellow, volute spring, leaf spring, gas spring or disc spring. The spring type may be used for designing an appropriate spring force exerted on the piston member, such as a constant spring force or a spring force that increases during projection of the arm so that the highest spring force is obtained at the outermost position of the arm.

By a casing is meant any kind of pipe, tubing, tubular, liner, string etc. used downhole in relation to oil or natural gas production.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

Although the invention has been described in the above in connection with preferred embodiments of the invention, it will be evident for a person skilled in the art that several modifications are conceivable without departing from the invention as defined by the following claims.

The invention claimed is:

1. A downhole tubing cutter tool for submerging into a casing in a wellbore and separating an upper part of the casing from a lower part of the casing by cutting the casing from within, the tool extending in a longitudinal direction, comprising:

a tool housing having a first and a second housing part, a cutting arm which is pivotably connected with the first housing part and has a cutting edge in a first end, said arm being movable between a retracted position and a projected position in relation to the tool housing, an arm activation assembly for moving the cutting arm between the retracted position and the projected position, and a rotatable shaft arranged in the second housing part and rotatably connected with the first housing part for rotating the cutting arm, wherein the arm activation assembly comprises:

a piston housing arranged in and rotatable relative to the first housing part and comprising a piston chamber, and a piston member arranged inside the piston chamber for moving the cutting arm between the retracted position and the projected position, the piston member being movable in the longitudinal direction of the downhole tool and having a first piston face, the piston member being capable of applying a projecting force on the cutting arm by applying hydraulic pressure on the first piston face and moving the piston in a first direction.

2. A downhole tubing cutter tool according to claim 1, wherein the piston chamber is divided into a first chamber section and a second chamber section, and the hydraulic pressure on the first piston face, moving the piston in the first direction, is applied into the first chamber section.

3. A downhole tubing cutter tool according to claim 2, wherein hydraulic pressure is applied into the second chamber section moving the piston member in a second direction opposite of the first direction.

4. A downhole tubing cutter tool according to claim 2, wherein the chamber is divided by a partitioning wall of the piston housing and through which the piston member extends.

5. A downhole tubing cutter tool according to claim 1, wherein a spring member is arranged in the first housing part applying a spring force to move the piston member in a second direction opposite the first direction.

6. A downhole tubing cutter tool according to claim 1, wherein the piston member has a groove cooperating with a second end of the cutting arm.

7. A downhole tubing cutter tool according to claim 1, further comprising a rotation unit, in the form of an electrical motor or a hydraulically driven impellor.

8. A downhole tubing cutter tool according to claim 1, further comprising a gear section.

9. A downhole tubing cutter tool according to claim 8, wherein the gear section is arranged between the rotation unit and the cutting arm.

10. A downhole tubing cutter tool according to claim 1, wherein the cutting arm comprises an outer sleeve through which an arm shaft extends, the arm shaft being coupled to the rotatable shaft and attached to a rotatable cutting head for transmitting rotational force to the cutting head.

11. A downhole tubing cutter tool according to claim 1, further comprising a gearing assembly provided in the first housing part, the rotatable shaft being coupled to a first gear of the gearing assembly and the arm shaft being coupled to a second gear of the gearing assembly, whereby rotational force is transmitted from the rotatable shaft to the cutting head via the arm shaft.

12. A downhole tubing cutter tool according to claim 11, wherein the gearing assembly is a planetary gear, the rotatable shaft being coupled to a sun gear of the gearing assembly and the arm shaft being coupled to a planet gear of the gearing assembly, whereby rotational force is transmitted from the rotatable shaft to the cutting head via the arm shaft.

13. A downhole tubing cutter tool according to claim 1, further comprising a rotatable sleeve provided around the rotatable shaft, wherein the first housing part is rotated by a rotatable sleeve.

14. A downhole tubing cutter tool according to claim 13, wherein the motor rotates the rotatable shaft and the rotatable sleeve.

15. A downhole tubing cutter tool according to claim 1, further comprising a pump for supplying the hydraulic pressure, the pump being rotatable arranged inside the tool housing, whereby the hydraulic pump rotates along with the first housing part and the cutting arm.

16. A downhole tubing cutter tool according to claim 1, further comprising a pump for supplying the hydraulic pressure for moving the cutting arm between the retracted position and the projected position, the pump being arranged inside the tool housing.

17. A downhole tubing cutter tool according to claim 1, further comprising a pump arranged in the tool for supplying the hydraulic pressure for moving the cutting arm between the retracted position and the projected position, and comprising a motor arranged in the tool for driving a pump and rotating the rotatable shaft, the motor being supplied with power via a wireline.

18. A downhole tubing cutter tool according to claim 1, further comprising an anchor section for anchoring the second housing part in the casing.

19. A downhole system, comprising:

a downhole tubing cutter tool according to claim 1, and a driving unit for moving the downhole tubing cutter tool forward in the casing.

20. A downhole system according to claim 19, wherein the driving unit is a self-propelling unit able to convey itself and the downhole tubing cutter tool forward in the well.

* * * * *